United States Patent [19]

Ott

[11] Patent Number: 4,905,637

[45] Date of Patent: Mar. 6, 1990

[54] DIESEL AIRCRAFT ENGINE—ALSO CONVERTIBLE FOR OTHER APPLICATIONS—OPTIMIZED FOR HIGH OUTPUT, HIGH SUPERCHARGE AND TOTAL ENERGY UTILIZATION

[76] Inventor: Edwin Ott, Wasserwerkstrasse 8, CH-8035 Zurich, Switzerland

[21] Appl. No.: 2,622

[22] PCT Filed: Apr. 11, 1986

[86] PCT No.: PCT/CH86/00047

§ 371 Date: Jul. 1, 1987

§ 102(e) Date: Jul. 1, 1987

[87] PCT Pub. No.: WO86/06136

PCT Pub. Date: Oct. 23, 1986

[30] Foreign Application Priority Data

Apr. 12, 1985 [CH] Switzerland ..... 1567/85

[51] Int. Cl.[4] ..... F02B 75/26

[52] U.S. Cl. ..... 123/58 B; 123/58 BC; 123/41.74; 123/196 R

[58] Field of Search ..... 123/58 BC, 58 B, 196 R, 123/196 AB, 193 P, 41.74, 41.79

[56] References Cited

U.S. PATENT DOCUMENTS

| | | | |
|---|---|---|---|
| 1,808,380 | 6/1931 | Royal | 123/58 BC |
| 1,978,194 | 10/1934 | Gray | 123/41.74 |
| 2,150,162 | 3/1939 | Hall | 123/41.74 |
| 2,354,620 | 7/1944 | Smith | 123/41.79 |
| 2,379,119 | 6/1945 | Tucker | 123/58 BC |
| 2,475,295 | 7/1949 | Sherman | 123/58 BC |
| 2,565,272 | 8/1951 | Sherman | 123/58 BC |
| 2,650,676 | 9/1953 | Jamotte | 123/58 BC |
| 3,007,462 | 11/1961 | Balzer | 123/58 BC |
| 3,212,483 | 10/1965 | Balzer . | |
| 3,528,317 | 9/1970 | Cummins . | |
| 3,805,524 | 4/1974 | Bachmann | 123/51 BA |
| 4,489,682 | 12/1984 | Kenny | 123/58 BC |
| 4,548,125 | 10/1985 | Huther | 123/193 P |

FOREIGN PATENT DOCUMENTS

| | | |
|---|---|---|
| 494891 | 9/1970 | Fed. Rep. of Germany . |
| 1564659 | 4/1969 | France . |
| 2301687 | 9/1976 | France . |
| 2544018 | 10/1984 | France . |
| 620 | of 1915 | United Kingdom . |
| 513999 | 11/1939 | United Kingdom . |

*Primary Examiner*—David A. Okonsky

*Attorney, Agent, or Firm*—Burns, Doane, Swecker & Mathis

[57] ABSTRACT

A diesel engine with a wobble plate for aircraft comprises cylinders of which the axis is arranged coaxially to the shaft. The pistons move into a cylinder and form a common combustion chamber. The pistons control the exhaust and intake with control times being modifiable by stepped pistons. The engine is supercharged by an exhaust gas supercharger associated with a mechanically controlled radial compressor.

13 Claims, 6 Drawing Sheets

| PARAMETERS | TYPE DESIGNATION | Vh LITERS | STROKE VOLUME mm | BORE AND STROKE | OUTPUTS-NORMAL SUPERCHARGE PS | AT RPM MIN -1 | ALTITUDE MIN. M | FLIGHT ALTITUDE | SPECIFIC CONSUMPTION g/PS h | OUTPUTS-HIGH SUPERCHARGE PS | AT RPM MIN -1 | SPECIFIC CONSUMPTION g/PS/h | COMPRESSION RATIO c Vh+Vc / Vc | AVERAGE PISTON VELOCITY m/SEC | STROKE λ-RATIO | BORE PS | CYLINDER OUTPUT PS/CM² | PISTON SURFACE | SPECIFIC PISTON OUTPUT | WIDTH m | HEIGHT m | LENGTH m | WEIGHT WITH NORMAL SUPERCHARGE kg | WEIGHT WITH HIGH SUPERCHARGE kg | NORMAL SUPERCHARGE kg/PS | HIGH SUPERCHARGE kg/PS |
|---|---|---|---|---|---|---|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 | 20 | 21 | 22 |
| 4XX61 | 6,107 | 90-2x120 | 230 | 2'400 | 9'600 | 147 | 290 | 2'400 | 150 | 17:1 | 9,6 | 2,66:1 | 72,5 | 0,569 | 0,47 | 0,69 | 1,30 | 165 | 169 | 0,72 | 0,58 |
| 5XX76 | 7,634 | 90-2x120 | 305 | 2'400 | 9'600 | 147 | 365 | 2'400 | 150 | 17:1 | 9,6 | 2,66:1 | 73,0 | 0,573 | 0,51 | 0,72 | 1,30 | 195 | 199 | 0,64 | 0,55 |
| 5XX89 | 8,906 | 90-2x140 | 350 | 2'400 | 9'600 | 146 | 425 | 2'400 | 149 | 17:1 | 11,2 | 3,11:1 | 85,0 | 0,668 | 0,56 | 0,75 | 1,41 | 234 | 240 | 0,67 | 0,56 |
| 6XX107 | 10,688 | 90-2x140 | 425 | 2'400 | 9'600 | 146 | 510 | 2'400 | 149 | 17:1 | 11,2 | 3,11:1 | 85,0 | 0,668 | 0,60 | 0,75 | 1,41 | 263 | 269 | 0,62 | 0,53 |
| 6XX122 | 12,214 | 90-2x160 | 485 | 2'400 | 9'600 | 145 | 585 | 2'400 | 148 | 17:1 | 12,8 | 3,55:1 | 97,5 | 0,765 | 0,65 | 0,81 | 1,56 | 309 | 318 | 0,64 | 0,54 |
| 7XX142 | 14,250 | 90-2x160 | 570 | 2'400 | 9'600 | 145 | 680 | 2'400 | 148 | 17:1 | 12,8 | 3,55:1 | 97,2 | 0,763 | 0,65 | 0,81 | 1,56 | 345 | 354 | 0,61 | 0,52 |
| 7XX160 | 16,031 | 90-2x180 | 640 | 2'300 | 9'600 | 144 | 770 | 2'300 | 147 | 17:1 | 13,8 | 4,0:1 | 110,0 | 0,864 | 0,69 | 0,88 | 1,75 | 394 | 404 | 0,61 | 0,52 |
| 8XX183 | 18,322 | 90-2x180 | 730 | 2'300 | 9'600 | 144 | 880 | 2'300 | 147 | 17:1 | 13,8 | 4,0:1 | 110,0 | 0,864 | 0,69 | 0,88 | 1,75 | 434 | 444 | 0,59 | 0,50 |

FIG. 2

DIESEL AIRCRAFT ENGINE—ALSO CONVERTIBLE FOR OTHER APPLICATIONS—OPTIMIZED FOR HIGH OUTPUT, HIGH SUPERCHARGE AND TOTAL ENERGY UTILIZATION

BACKGROUND OF THE INVENTION:

Even though certain well know companies in Europe and the USA have developed diesel aircraft engines, they have not found favor in actual applications, as they were affected by considerable handicaps and deficiencies. The fact is that at the present time not a single diesel aircraft engine is in use or production anywhere in the world!

In particular, the specific weight per unit power, of these experimental engines was within a range of 1.5 to 1.0 kp/PS, which represented a significant disadvantage relative to the most favorably regarded spark ignition gasoline engines with about 0.95 to 0.60 kp/PS. (The higher value relates to small engines, the lower value to engines from about 900 PS on.) The exceptions are certain engines for military aircraft beginning at about 1 400 PSm with roughly 0.45 kp/PS.

The specific fuel consumption of the experimental diesel aircraft engines of 195 to 165 g/(PS/h) was not sufficient to justify the high weight by unit power or to compensate for it, even over longer flights.

The reason of the much higher weight of diesel engines—in their configurations prevalent heretofore—compared to spark igniters, are adequately known, i.e. the compression and combustion pressures are approximately twice as high or even more, as that of as spark ignition engines.

The higher static and dynamic stresses to which conventional diesel engines are exposed necessarily lead, in view of the larger dimensions required, to higher weights, for example: heavier crankshafts, heavier connecting rods, requiring heavier counterweights, bearings, housings and also heavier cylinder heads.

In a manner similar to vehicle design, the demand for diesel engines for aircraft appeared only after the "energy crisis". Today, however, a need for such engines is clearly audible in the professional literature. A principal reason is the high and still rising energy prices. Further reasons, not less important, are the significantly longer flight durations and ranges, together with higher payloads with identical tank capacities, because the specific fuel consumption of a good diesel engine, with direct injection, which is less by 25 to 35% than the gasoline engines presently in use, is able to provide certain savings.

The clearly improved operating safety, due mainly to the absence of ignition devices, which are the source of many of all problems, and the elimination of the danger of fire due to the inflammability of diesel oil being above 55° C., are hard advantages relative to gasoline engines.

The economic and safety advantages of diesels relative to the present gasoline engines are generally know. However, the problems involved in the design of such a diesel engine with all of these advantages, but without the disadvantages, are not known as well.

The most important differences up to now are:

(a) gasoline aircraft engines:

1. Weight by unit power: relatively good
2. Specific consumption: relatively high
3. Reliability: acceptable (b) diesel aircraft engines: (experimental unit) up to now:

1. Weight by unit power: too high
2. Specific consumption: optimal
3. Reliability: very good Consequently, if a way could be found to reduce the specific weight by unit power of the diesel engine, all of the advantages would be attained. As the requirement of an optimum specific weight cannot be realized, there exists a need for a novel technology.

SUMMARY OF THE INVENTION

The engine shown in a longitudinal section in FIG. 1 and according to the table of FIG. 2, Type 4XX61, has an output with a working volume of 6.107 liters, of 162 KW, (220 PS) at 2,400 $min^{-1}$, a weight of 165 kp, consequently; 0.75 kp/per PS=1.019 kp/KW.

This corresponds to the specific weight of present spark ignition engines of the same power class, or may be better, because the exhaust turbocharger, the exhaust system, starter system, the cooler for the charge air and the cooling medium are included in the weight, together with the heat exchangers for the lubricating oil. However, weight data of present day gasoline aircraft engines should be analyzed.

However, designed for high output and high supercharging, this engine produces even with a "moderate" supercharge according to Column 8, Table 2, 265 PS=195 KW, with an additional weight of only 4 kg, in continuous charger operation. Specific consumption rises in this case by max. 2 g per PH/h, because of the increased power consumption of the charger. However, the limit of the output has not been attained so far. G/N=169 kp/265 PS yields 0.64/per PS=0.866 kp/KW.

The technical innovation of the invention consists of varying the control times during the operation of the engine, i.e. automatically and as a function of the charging pressure, displaying variables and closing the exhaust and inlet slots, for optimum efficiency. Variable power requirements such as low and high flight altitudes are especially important.

The charging system includes a combination of at least one exhaust gas turbocharger with a mechanically driven radial charger, which is altitude dependent, output dependent and automatically regulated for a high charge.

With this system the outputs listed in the table, FIG. 2 may be increased by approximately 20% without problems and without a loss relative to specific consumption, or 25% or more with only a slight deterioration of specific consumption. (Exhaust $-\Delta p+\Delta t$). The latter is, however, only minimal within a range of 1.5+2%, because simultaneously the efficiency of the exhaust turbocharger is improved with higher outputs, i.e. only during starting and short term outputs, which is relatively.

The desired and obtained advantages relative to the present piston aircraft engines result from the following causes: Relative to weight=specific weight per unit output:

Comparative unit Type 4XX61, according to the table of FIG. 2 is of the 4 cylinder, 8 piston type and corresponds to a conventional 8 cylinder engine.

This permits the elimination of 8 cylinder heads with their 16 to 32 valves, valve guides, springs, valve seats, rocking levers and bearings, hydraulic elements for clearance compensation, tappets, possibly push rods, together with 1 to 2 cam shafts and their gears, bearings and housings. This without any replacement of corresponding parts.

Replacement of crankshaft with counterweights is required by a straight hollow shaft, with two wobble plates on bearings and only four main bearing locations.

BRIEF DESCRIPTION OF THE DRAWINGS

FIG. 2 in a table of operating characteristics of the engine;

DETAILED DESCRIPTION OF THE PREFERRED EMBODIMENT

Figure 1:
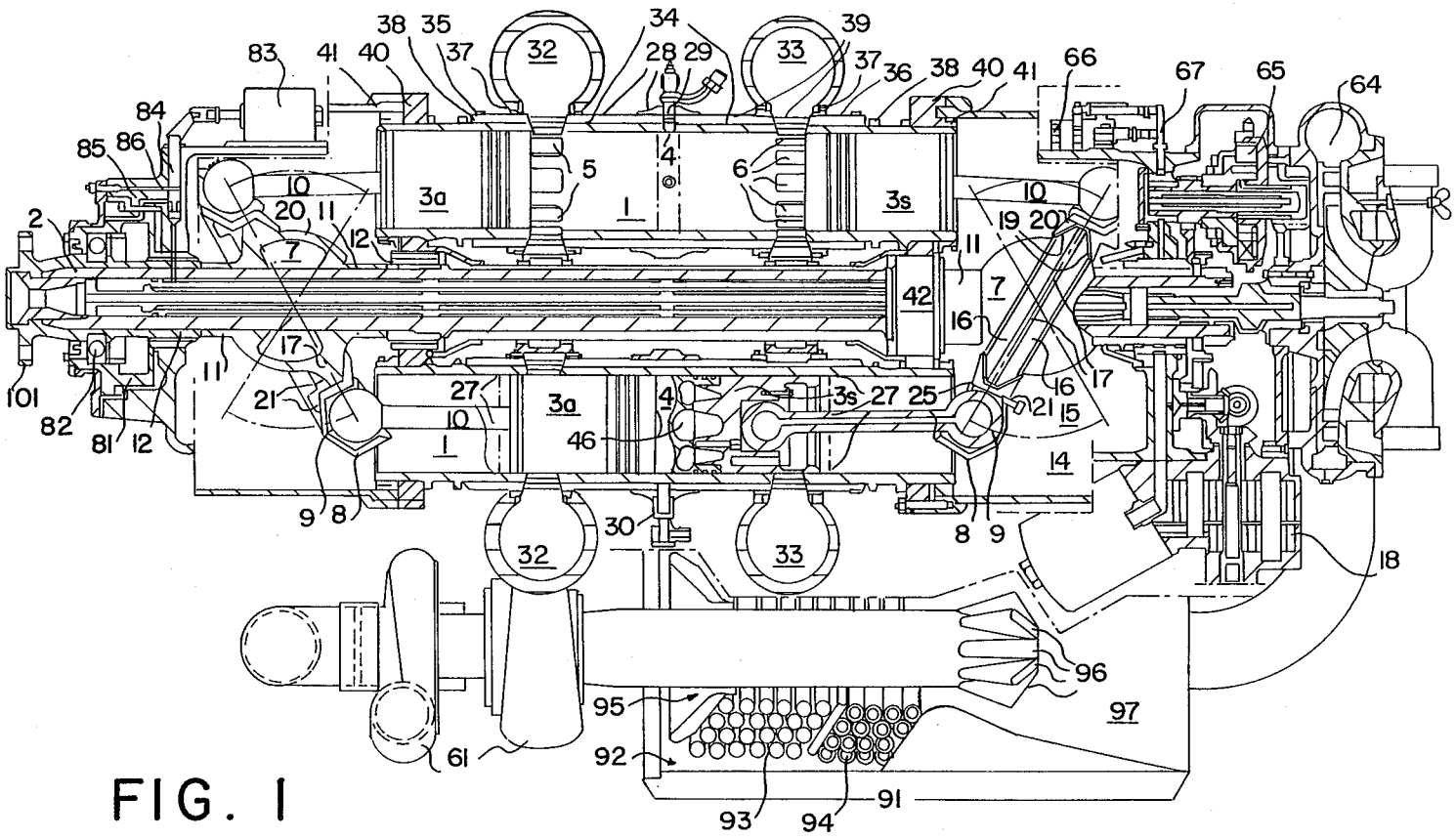
FIG. 1 is a longitudinal side view, in cross-section, of the aircraft diesel engine.
Figure 4:
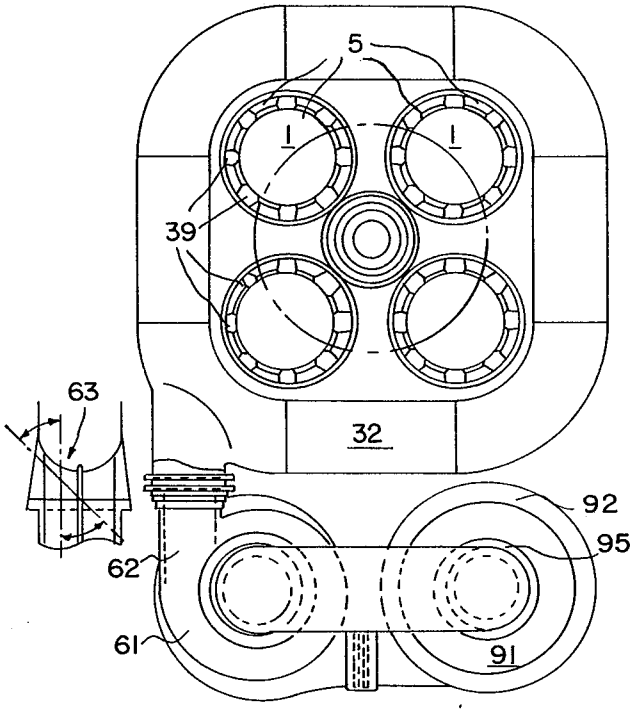
FIGS. 3–7 are various cross-section views of FIG. 1.
Figure 3:
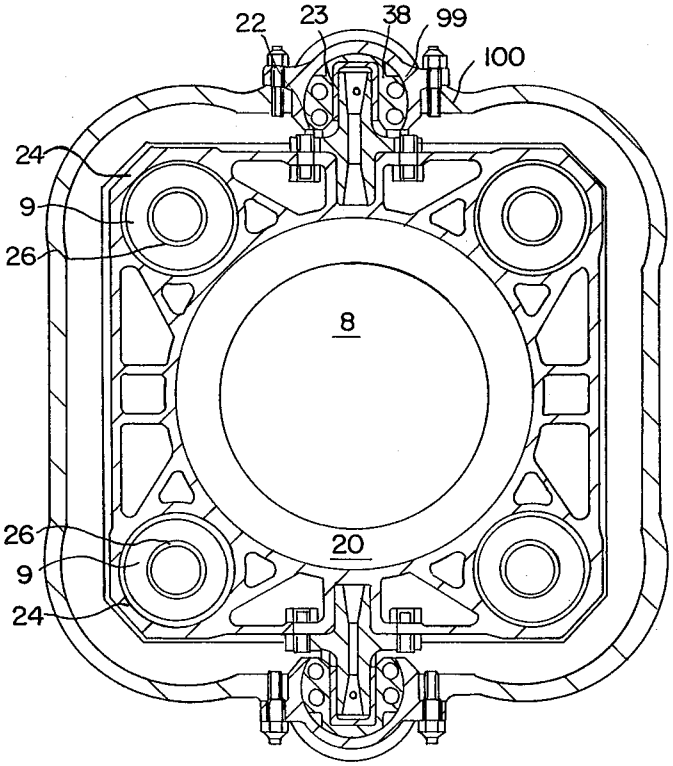
Figure 6:
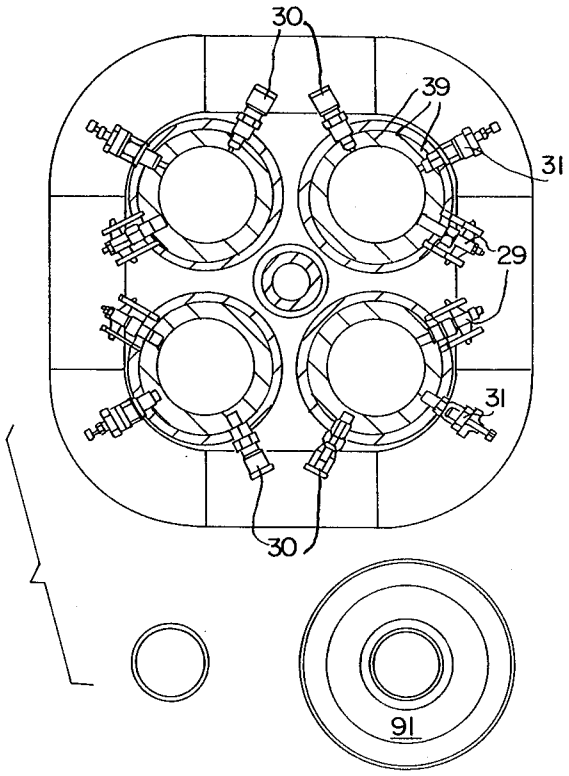
Figure 5:
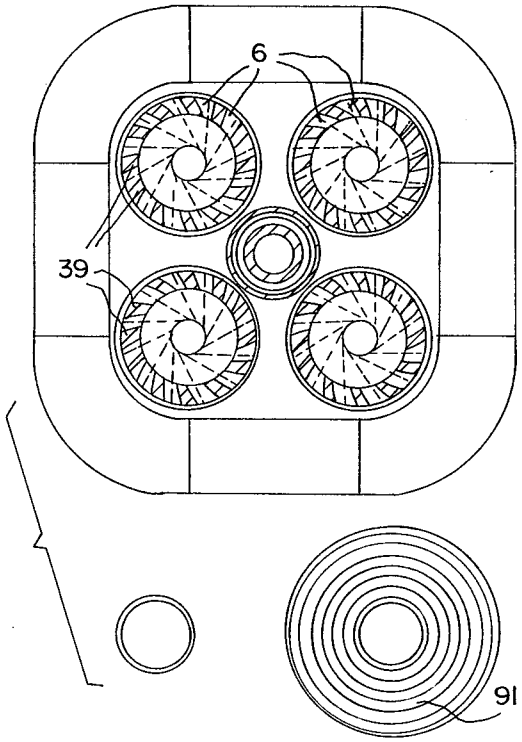
Figure 7:
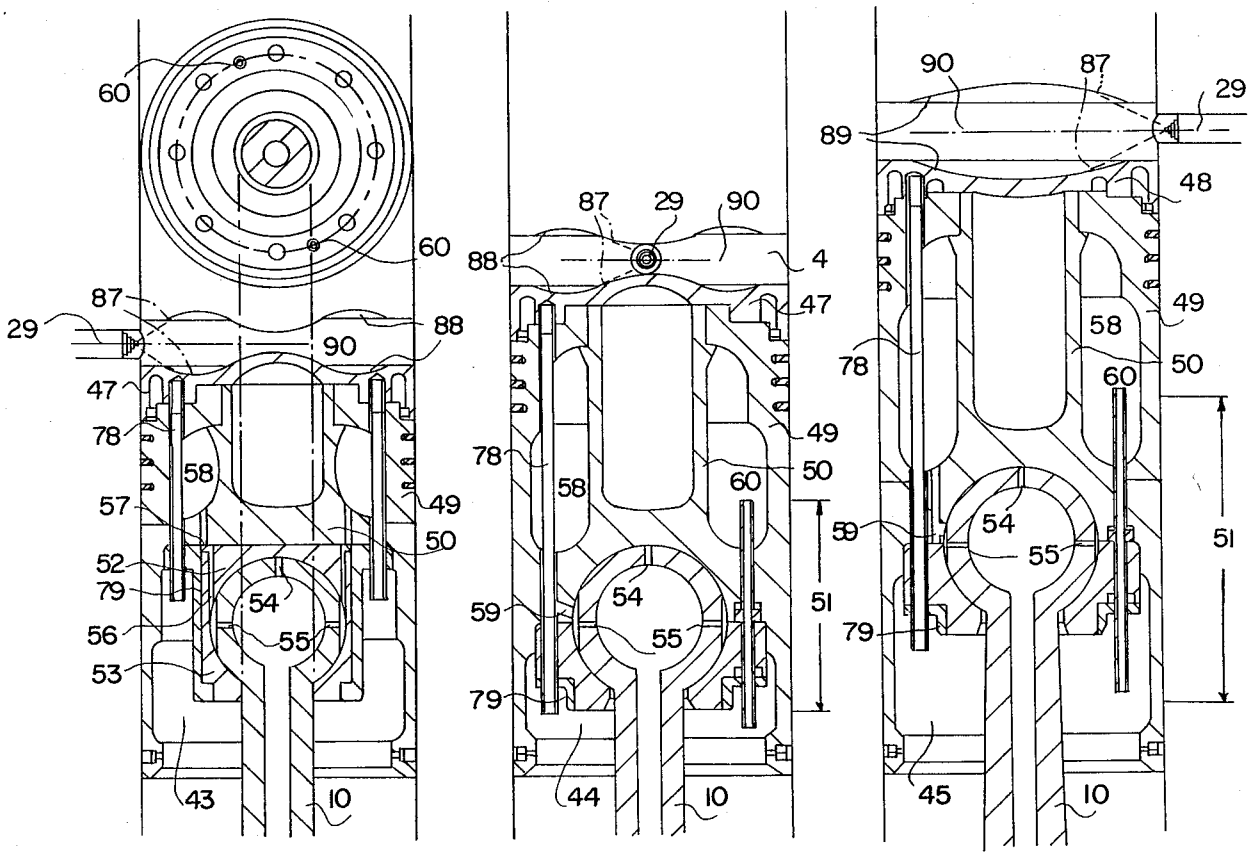
Figure 9:
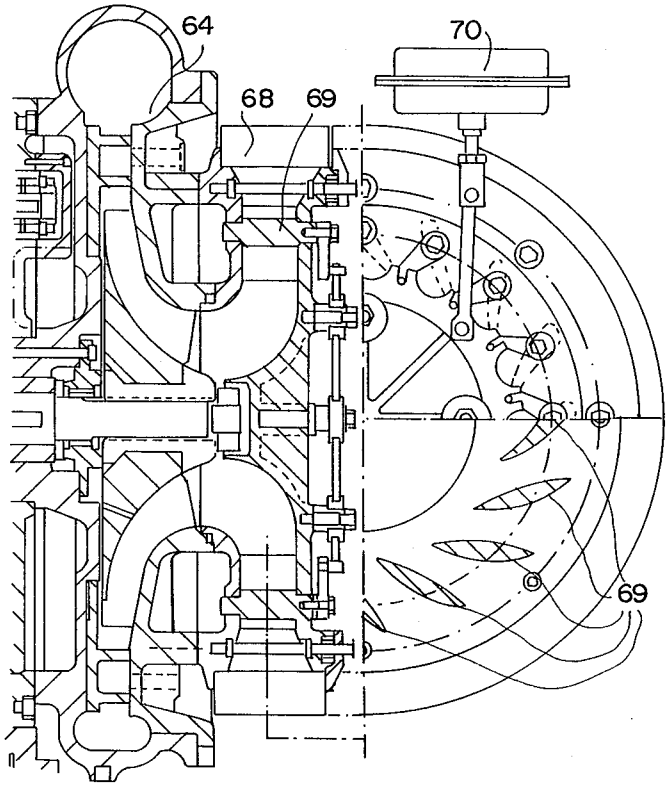
FIG. 9 is an enlarged, partial view, of the compressor arrangement of the engine.
Figure 8:
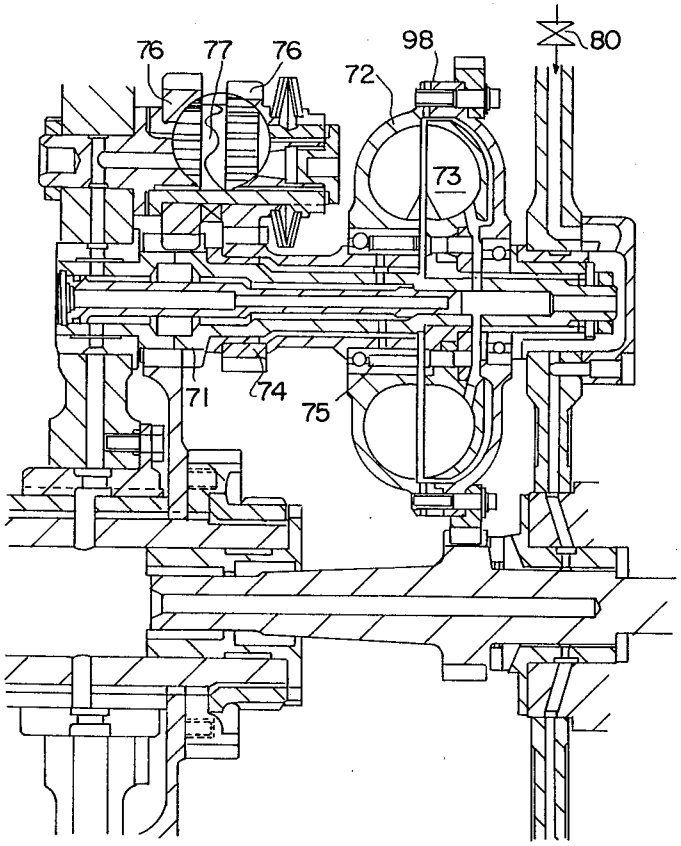
FIG. 8 is an enlarged, partial view, of the coupling arrangement of FIG. 1.

An aircraft diesel engine which is also convertible for other applications and is optimized for high output, high supercharge and total energy utilization is characterized by a predetermined number from, for example, 2 to approximately 10 cylinders 1 being open on both sides and arranged in a parallel, circular and concentric manner around an output shaft 2. Two pistons 3 per cylinder move simultaneously respectively against and away from each other and form a common or shared combustion chamber 4. One of the pistons controls the outlet slot 5 and the other piston controls the inlet slot 6 of the cylinder. The output shaft 2, arranged in the center, carries thereon and outside the cylinder ends a wobble bearing 7 at each end. A wobble plate 8 is seated on each of said wobble bearings and each includes a plurality of ball sockets 9 on its circumference equal in number to the number of cylinders. Connecting rods 10 with spherical ends on both sides are seated in both of the ball sockets of the pistons 3 and in the ball sockets of the wobble plates 8.

The output shaft (2) is provided on both ends with serrations, whereby the wobble bearings (7) are located with the indexing position desired and centered by cones (11), together with the main bearing bushings (12). The propeller flange (101) may be adapted to different standard sizes and requirements and is easily replaced.

The wobble bearings (7) are in the form of step bearings, but with conical bearings flanks (16), with said flanks (16) preferably including the same angle with the wobble plane (13) as the wobble plane with the normal to the axis (14) of the output shaft. This angle preferably amounts to approximately 30° and may be in the range of from about 24° to about 36°. This also corresponds to the necessity that in the compression position of the piston (3), respectively, at the onset of combustion which is equal to maximum pressure in the combustion chamber (4), the axis (15) of the connecting rod should be perpendicular to the bearing flanks surface of the wobble bearing (16). The bodies of the wobble bearings (7) are in the form of hollow spheres for static, dynamic and weight reasons.

The lubricating oil bores holes (17) arranged in adequate numbers in the wobble plane (13) between the two sliding surfaces assure, as in a centrifugal pump, the highly desirable increase in the lubricant pressure beyond the general system pressure produced by a gear pump (18), for the wobble bearings and ball sockets in the pistons and the wobble plates.

Two conical bearing elements (19) are arranged floatingly on the wobble bearings (7), as pillows upon which the wobble plates (8) are resting. The shape and configuration of the wobble plates (8), strengthening ribs, etc. are laid out in keeping with static and technical manufacturing requirements, i.e. preferably in the form of drop or press forgings and simultaneously for optimum static strength, wear resistance and a minimum of processing costs, made preferably of a low distortion nitriding steel. The wobble plates (8) are forming together with the integral bearing flange (20) and the counter flange (21) as a closed, rigid bearing housing. The bearing surfaces are preferably hardened by nitriding.

The points (24) of the wobble plates are in the form of sockets to receive the ball sockets (9) and ball joints (25), together with bolts and other fastening elements. The ball sockets (9) comprise a circular lubricating groove (26) to assure a continuous flow of oil for the lubrication and cooling of all bearing locations and the cooling of pistons.

The wobble plates (8) are equipped with 1 to 3 pivots (22) and slide blocks (23) so as to absorb the reaction forces and counter torques and depending on the number of cylinders and the detail layout of the engine. The slide block or blocks (23) oscillate back and forth in thrust bearings, in keeping with the wobbling motion. The thrust bearing or bearings (38) are flanged in a bearing shell (99) onto the engine housing (100) and secured thereto.

Connecting rods (10) are carried on both ends hollow spheres, which, with ball sockets (9) and ball joints (25), establish the connection between the pistons (3, 43, 44, 45) and the wobble plates. The hollow connecting rods (10) also assure the transfer of lubricating oil to the pistons, for the spray lubrication of the cylinder running surfaces (27), and in most cases also for the cooling of the pistons. The configuration of the connecting rods requires a special manufacturing process and material and the connecting rods are hardened.

The cylinders (1) are manufactured in a novel composite configuration, wherein the base body, made of a light metal alloy, is provided in the center of the cylinder, within the area of the combustion chamber, from the upper edge of the exhaust slot to the upper edge of the scavenging slot, with a steel sleeve (28) shrunk onto said body. This steel sleeve has the following simultaneous functions:

(a) to statically and dynamically supplement the light metal cylinder (1),
(b) to serve as the cooling medium jacket (34),
(c) to hold and fasten the injection nozzles (29), the valves for the starting air (30) and the safety valves (31),
(d) to support the exhaust manifold (32) and
(e) to support the scavenging air distributor (33).

The steel sleeves (35) and (36) also serve simultaneously:

(a) as the outside support of the exhaust manifold (32),
(b) as the outside support of the scavenging air distributor (33),
(c) to prestress the metal 0 rings (37) in the exhaust manifold (32),
(d) similarly of the scavenging air distributor (33),
(e) as the cooling medium jacket, both on the inlet and the outlet side.

To prestress the metal 0 rings (37), V-shaped strap retainers (38) are provided, but in cases with a very high prestress, these are strap nuts.

The cylinders are made of a light metal alloy, preferably extruded or seamlessly drawn. $\sigma_B$ 300 to 370 N, at 20° C., $\sigma_S$ 280 to 340 N at 20° C., respectively $\sigma_B$ 250 to 300 N, at 150° C.

The cylinder bores are coated with a hard chromium layer.

Alternatively to extruded or seamless drawn cylinder materials, light metal die cast cylinders are used, wherein the inlet (6) and exhaust (5) slots and the coolant chambers are cast and do not require further processing.

The cylinders (1) are made of a hypereutectic Al-Si alloy containing approximately 17% Si (for example ALUSIL or SILUMAL). No coating of the running surfaces is necessary, but a special honing and etching process is required. The pistons are provided in this case with a thin chromium or iron layer.

When providing engines for non-aircraft applications and for reasons of costs, cylinders (1) of a nitriding steel are provided, with a corresponding adaptation of the material cross sections. The cylinder bores in this case are preferably hardened by nitriding. For stationary power plants, on the other hand, cylinders of a special cast iron and preferably made by centrifugal casting, are installed.

To assure an omnisymmetrical distribution of heat, in order to prevent thermal stresses, all of the cylinders (1), together with the exhaust (5), and the scavenging slot (6), are identical over the circumference and are distributed uniformly and regularly. Each of the webs between the exhaust and scavenging slots comprises a lubricant bore hole (39) and the cylinder center piece is provided with an adequate number of cooling bores.

The cylinders (1) are fastend at their ends only in a frame (40) each comprising the same number of seating bore holes as there are cylinders the fastening is preferably done free of stress and preferably by means of ring nuts (41).

Any adaptation necessary in view of the degree of supercharging and the size of the engine is made possible by three different forms of embodiment of the piston barrels as shown at (3, 43, 44, 45) and three different forms of the piston head (4, 47, 48), with the piston barrels (3, 43, 44, 45) being made preferably of a light metal alloy and the piston heads of a heat resistant steel.

For engines of the "ultralong stroke" type, the pistons are made in the composite mode. The piston barrel shaft (49) and core (50) are made in two or three parts and joined together by electron beam welding. The core material and the shaft may then be combined of different alloys in an ideal manner.

As an alternative, instead of the piston heads being made of steel (46, 47, 48), a light metal piston bottom, both separately and integrally, is provided with a ceramic layer. The configuration of the piston heads (46, 47) and (48) would remain unchanged.

The piston shafts of the "superlong stroke" and "ultralong stroke" types are provided with a "waist" section (51), i.e. a section with the center part of the piston shaft (51) between the compression and the oil rings being of a smaller diameter. This diameter reduction should preferably be between approximately 1 to 2% of the diameter of the sliding parts. The purpose of this arrangement is:

(a) To reduce the sliding surfaces and thus the sliding friction.

(b) To prevent jamming in case of a warping of the cylinder or the piston.

The ball sockets (52) with their ball joints (53), made of a special bronze, are set as the connecting rod bearings in the pistons (3) and (43). In special cases, they may consist of a plastic, such as for example KINEL. The preferred fastening modes are continuous tie rods (78) from the piston heads (47, 48) to holding bushings (79), and directly in ball joints (53). Tie rods of a corrosion resistant titanium alloy or steel are preferred.

The piston configuration (44, 45) of the spherical head of the connecting rod (10) is bearingly supported directly in the light metal body, whereby the spherical head may be dimensioned larger than the bronze cup. The composite configuration of the piston barrel further makes possible the suitable alloying of the piston core, independently of the piston shaft, for the most favorable sliding and wear properties.

In particular the branching of the oil pressure in the spherical head of the connecting rod (10):

(a) consists at the tip, the location having the highest specific bearing load, of a pure lubricating bore (54), while:

(b) at the periphery of the spherical head, approximately perpendicular to the longitudinal axis of the connecting rod, separate bores (55) are provided for the branching of the cooling oil. The sum of the cross sections for the branching of the cooling oil should attain a maximum of 50% of the lubricating bore cross section in the zenith of the spherical head.

The cooling oil branched and metered off the connecting rod (10), is conducted, depending on the type of the piston, as follows:

Through bores in the ball socket (56) of the connecting rod, in the annular channel (57) formed by the piston barrel and the bevelling of the aforementioned ball sockets. From here, by means of preferably two or more bores directly into the piston cooling chamber (58).

When here the ball socket is an integral part of the piston, preferably by short, inclined bores opening into the tie rod passages with enlarged cross section (59).

The cooling of the pistons is effected according to two different methods, depending on the configuration of the piston:

(a) by the "shaking cup" method, wherein a "riser pipe" or "immersion tube" (60) in the cooling chamber of the piston, determines the volume and thus the mass of the oil to be cooled, by its length.

(b) By the pass-through method, wherein the immersion tube (60) for the recirculation of the cooling oil is positioned just under or adjacent the bottom of the piston.

The specific combustion process and the specific scavenging process are integral. The cylinder scavenging and supercharging system is laid out in a particularly flexible manner for variable a output ranging from low to high supercharging. and from sea level to high flight altitudes. One or several exhaust gas superchargers are preferably connected directly with the exhaust manifold (32). The turbine intake is effected by means of a double screw type intake channels, i.e. two independent exhaust gas intake coils (62), with one of the channels being equipped with a butterfly valve (63). The valve (63) is actuated automatically as a function of the volume of fuel injection. It remains closed until approximately 55 to 60% of the maximum fuel injection is attained and opens completely, without an intermediate position. This assures a high velocity of the gas during the turbine intake, even during a low engine output, leading to a high average efficiency of the exhaust gas turbine. The valve is actuated preferably mechanically by means of gears. In the alternative, the valve may also be operated electromagnetically, pneumatically or hydraulically.

In such an arrangement the exhaust gas turbocharger or chargers (61) are preceded by a mechanically driven radial compressor (64).

This preceding compressor is actuated and deactivated as needed by means of a coupling (65), automatically as a function of the supercharging pressure. A membrane cell (66) with a connecting line to the scavening air distributor (33) actuates a control valve (67), with the oil pressure of the lubricating system being used to vent the coupling (65). In this operating mode the supercharger is actuated as follows:

(a) During the starting process when the exhaust gas turbine is not yet operating.

(b) During flight at high altitudes (increasing the full pressure level).

(c) When the pressurized cabin is supplied by charging air, dependent on the air required and providing a safety redundancy.

(d) If the exhaust gas turbocharger fails or produces an insufficient output the supercharger provides a safety redundancy.

In place of the radial compressor (64), other types of chargers, such as for example Roots, single-tooth or vane chargers, are used. These chargers are also driven by means of a coupling (65), with actuation and deactivation being effected in accordance with the foregoing. For stationary power plants the switchable coupling (65) may be omitted. This also eliminates the automatic on/off device described above.

Alternatively and in particular in the case of large engine units, the mechanically driven compressor (64) is constantly running, while the scavenging or charging pressure at the compressor inlet (68) is continuously regulated by means of variable throtte guide vanes (69). These inlet guide vanes are shaped and arranged in a manner such that the efficiency of the compressor attains an optimum over the entire output range as a result of the twist imparted by the guide vanes to the incoming air flow.

Regulation of the intake guide vanes (69) at the compressor inlet is actuated, preferably by means of one or several membrane cylinders (70), directly by the compressor pressure. In the case of large engine units this is effected alternatively by means of hydraulic oil pressure cylinders or hydraulic regulating motors.

This regulation, i.e. the compressor pressure, is controlled as a function of the fuel injection volume set by the power lever such that each amount of the fuel injected into the cylinder is associated with a certain nominal compressor pressure. A membrane cell (70) measures the pressure in the scavenger air distributor and compares it with the position of the power lever on the injection pump. Any difference between the setting is utilized as a signal to:

(a) directly vary the guide vanes (69) by means of the membrane cylinder (70), and (b) in the case of large engine units, by means of oil pressure control valves and oil pressure cylinders or hydraulic regulating motors.

When a high degree of supercharging is utilized, the mechanically actuated compressor (64) is driven continuously. In this embodiment, on the primary countershaft (71) a turbo clutch (72) is bearingly supported, i.e. the pump wheel (73) of the rotationally variable coupling is driven directly by said shaft.

A second shaft, i.e. a hollow shaft (74) is a secondary countershaft and is bearingly supported on the primary countershaft (71). The latter drives by means of a free wheel clutch (75), the housing (72) of the turbo clutch. The hollow countershaft is in turn driven by the two intermediate gears (76, 76*a*) with the insertion of an elastic clutch (77) to dampen rotary oscillations and pulse effects, respectively, during low rpm operation and in idling.

The regulation of supercharging during a high supercharge operation operates in the following manner:

(a) The exhaust gas turbocharger or chargers (61) always run fully, i.e. it or they are never throttled. The butterfly valve (63) serves only the purpose to maintain the velocity of the gas upon its entry into the turbine at as high a flow rate as possible.

(b) Upon stopping, in idling and with rising engine rpm, the charger inlet throttle guide vanes (69) are fully open under spring pressure. When the nominal supercharge pressure is attained or exceeded in keeping with the position of the injection volume lever, the inlet throttle guide vanes; are closing, actuated by the supercharge pressure on the membrane cylinder (70), until the nominal pressure is attained.

(c) When the throttle guide vanes (69) at the supercharger inlet are fully open, the control valve (80) for oil filling and thus the actuation of the turbo clutch (72) of the supercharger drive is also fully open. With the progressive filling of the turbo clutch, the rpm of the supercharger and thus the supercharge pressure is similarly increasing.

(d) When the nominal supercharge pressure is attained or exceeded, the flow of oil to the turbo clutch is throttled in reverse order, i.e. by the control valve (80), which in turn depends on the position of the throttle guide vanes (69).

(e) The bores (98) located on the circumference of the turbo clutch (72) always permit the exit of a slight volume of the clutch oil in order to remove the heat generated and to maintain the operating temperature constant by the flow of fresh oil. If the clutch is inactive, a minimum flow of oil removes the heat (by air ventilation) and also minimizes the delay in acuating the clutch.

Cylinder scavenging and supercharging is based on the co-current flow process, which in the present configuration and compared with all other possible variants offers the lowest flow resistance. Only in the exhaust gas turbine or turbines is a useful dynamic pressure generated in the course of their energy conversion. The flexibility of this engine in being able to operate from sea level to an altitude of several thousand meters (which is absolutely necessary in the case of an aircraft engine), together with low to high supercharging, makes possible a design with variable control times as a function of the supercharge pressure.

The stepped piston (81) with radial bearings (82) located on the main shaft (2), determines the axial position of the main shaft. In the rest position and in low power operation and therefore at a low supercharger pressure the main shaft is in its front terminal position. The two wobble bearings (7), fixedly connected with the shaft by means of serrations, communicate to the other elements, the wobble plates (8), connecting rods (10) and pistons (3) the prevailing position relative to the exhaust and scavenging slots (6).

In the case of engine outputs up to approximately 60 to 80% power outputs (according to specifications) the main shaft (2) operates in its foremost position. A membrane cell (83) exposed to the supercharge pressure in the scavenging air distributor, actuates the oil pressure control valve (84) as soon as the predetermined variable pressure is exceeded. This frees or opens the oil channel (85). As the result, the oil pressure is acting on the front side of the stepped piston (81). The oil pressure control valve (84) has simultaneously opened the channel (86), whereby the oil pressure is vented at the rear side of the stepped piston (81), i.e. the oil is able to flow back into the housing. As a reaction, the stepped piston (81) moves rearward together with the shaft (2) and all of the components connected with it. The front pistons (3A) carrying the exhaust, open these slots later and no longer completely and said slots are also closed earlier. The dynamic pressure generated in the cylinder in this manner is necessary for the buildup of pressure in case of a high supercharge and it is simultaneously supported by the dynamic pressure in the exhaust gas turbine or turbines in the course of their energy conversion. The rear pistons (3S) which control the air inlet, open earlier and close later. The full slot cross section is therefore open longer (time cross section) and the supercharging of the cylinder is effectively assisted.

The air inlet slots (6) are arranged tangentially in the cylinders in order to place the "supercharging" combustion air in rotation during its inflow. This rotation or "twist" is independent of the inflow angle of the scavenger slots, the supercharge pressure and the rpm. In the present engine types, according to Table 2, the supercharge air blown in rotates at an engine rpm of 2,100 to 2,400 at approximately 640/sec$^{-1}$. With cylinder bore diameters of for example 90 mm, the flow velocity in the $\frac{2}{3}$ zone of the cylinder = 60 mm, = 120 m/sec, and at $\frac{3}{4}$ of the cylinder, $\phi$67.5 mm = 135.7 m/sec. This signifies a combustion chamber with an "ultrarapidly" rotating combustion air, i.e. an "ordered" air motion with only slight "secondary vortices", as there is no interference by projecting parts or holes.

The combustion process of the engine and thus the configuration of the combustion chamber are designed for a "multiphase" combustion process. This means preferably a combination of air distributing and wall distributing injection. The form of the piston heads (88, 89) is such that preferably $\frac{2}{3}$ of the amount of fuel injected is sprayed onto their concave rotation surface and $\frac{1}{3}$ into freely rotating air mass. The percent proportion may be varied, i.e. adapted to the grades and properties of the fuel used. Under certain conditions, a completely wall distributing or air distributing injection may be appropriate.

The injection nozzles (29) are preferably in the form of 6 hole nozzles and are installed in a manner such that four jets provide $\frac{2}{3}$ of the amount injected are sprayed at an accurately predetermined angle, in a range of from 4° to 18° (87) onto the concave surfaces (88, 89) of the piston heads, i.e. two on each piston, whereby fuel films with a layer thickness of approximately 4 to 8/1 000 mm are produced. The rotating air mass provides uniform distribution. In the process, the piston heads are being maintained by indirect cooling at an ideal temperature of approximately 320°. This concept eliminates the undesirable, smoke producing "cracking" of this partial injection volume.

The other two injection jets provide $\frac{1}{3}$ of the volume injected which is sprayed directly into the ultrarapidly rotating, highly compressed combustion air at approximately 550° C., divided into very small droplets and distributed homogeneously. The chemical reactions, cracking and finally the inflammation of the droplets, take place with a minimum delay. This primary combustion of the fuel injected between the pistons (90), forms a "ring of fire" with a center at about 0.8 of the cylinder diameter. As the density of the burning gas particles, due to the high temperature, amounts to only approximately 0.3 of the compressed mixture that is not yet burning, they move toward the center. The non-burning cooler air and a mixture with a density g of 1.0, tends to the outside due to the centrifugal force of the mixture moving past the piston walls. This body of air, rotating within itself or three-dimenionally, entrains the preoxidized fuel vapors rising from the piston heads, whereupon they are rapidly inflammed and burned.

This extensively controlled, multiphase combustion process results primarily in the dynamics of the pressure rise in the cylinders, whereby a relatively small amount of the fuel, approximately $\frac{1}{3}$, is inflammed initially with little delay, leading at the onset to a "flat" pressure rise. Secondarily, however, after the onset of the combustion of the preoxidized fuel film of the pistons, a very rapid burnout or through burning of the remaining $\frac{2}{3}$ of the fuel takes place with a progressive rise in pressure. A relatively "soft running" of the engine is thereby programmed.

The "ultrarapidly" rotating combustion mixture with the similarly active secondary vortices assures after the onset of the primary combustion a high uniformity of the mixture without zones with oxygen deficiencies. The complete absence of cylinder heads reduces the intensively cooled surface in the combustion chamber to 23.7%, i.e. the cylinder wall only. With a compression ratio of $\epsilon = 18:1$, this engine is relatively "heat tight".

All of the aforementioned individual advantages add up to an unusually high total, above the average of conventional diesel engines. They provide the desired and attained conditions for a particularly smokeless, high power density, low specific consumption and few contaminants.

Of course, for the purpose of optimizing the combustion using special, future or nonstandard fuels, i.e. kerosene, etc., multiple hole injection nozzles are used but may require individually different jet lengths and bores.

The cooling system is designed for total energy consumption, wherein the thermal energy of:

(a) the cooling of the supercharged air,
(b) the cooling of the cylinders (coolant),
(c) the lubricating and piston cooling air,
(d) the residual heat of exhaust gases, after the exhaust gas turbine, and
(e) the kinetic energy of exhaust gases, is combined and concentrated in a cooling system in the form of a venturi (91) and converted into thrust. The air flow generated in flight by the dynamic pressure in the venturi cooler (91) enters the venturi cooler through the annular gap (92) and flows past the ribbed tubes of the supercharger air (93) and those of the coolant/lubricant (94), whereupon, heated by said tubes, it flows toward the center.

The air which is exposed to the same dynamic pressure in the center of the venturi cooler (95) accelerates its flow velocity in view of the narrowing of the cross section. This produces a vacuum behind the narrowest location, which may attain twice or more the value of the dynamic pressure. The air heated on the ribbed tubes (93, 94) is thus suctioned off and entrained and accelerated by the intensive flow of air in the center. The star-like configuration of the terminal piece (96) of the exhaust pipe effects the mixing of the exhaust gases with the cooling air, whereby the latter is heated to a maximum. Additionally, the kinetic energy of the even more rapidly exiting exhaust gases further accelerates the gases expanding in the diffusor (97) upon impact. Functionally this operation is in the manner of a ram jet engine, wherein thrust and efficiency depend primarily on the heat supplied by all of the cooling and heating media, i.e. the $\Delta T$ from the cooling air inlet to the outlet.

For this reason, the present diesel engines are operated preferably with cooling media temperatures of 120° C. or more (the cooling medium is glycol), in order to raise the partial and overall efficiencies to an optimum.

A further advantage results whereby the improved heat exchange efficiencies make possible the use of a correspondingly smaller and thus lighter venturi cooled thrust assembly.

The layout and configuration of the terminal piece (96) of the exhaust pipe provides already in the heating phase of the engine and during idling a sufficiently intensive cooling air flow by injector action, so that separate cooling air blowers may be eliminated.

I hereby claim:

1. A diesel engine comprising a plurality of cylinders open on opposite ends and arranged in a parallel and concentric manner around an output shaft, two pistons being mounted for reciprocating movement in each cylinder toward and away from each other to form a common combustion chamber between the pistons, each cylinder having air inlet slots and exhaust outlet slots with one of said pistons controlling flow of gas through the outlet slot of the cylinder, the other of said pistons controlling flow of air through the inlet slot of the cylinder, the output shaft having a wobble bearing on each and and a wobble plate seated on each of said wobble bearings, the output shaft provided on both ends thereof with serrations and the wobble bearings cooperate with said serrations to maintain a predetermined indexing position centered on the output shaft, said wobble plate and said wobble bearings being mounted for rotation about a central axis that is aligned with said output shaft, said wobble plate being provided with a plurality of circumferentially arranged ball sockets corresponding to the number of cylinders, said wobble bearings are conical bearings maintaining said wobble plate in a predetermined wobble plane, the wobble plane intersecting the axis of the output shaft at an acute angle, said angle corresponding to a compression position of the piston in which an axis of one of the connecting rods is perpendicular to a surface of the wobble bearing, ball sockets on each of the pistons and connecting rods provided with spherical ends being seated in the ball sockets of the pistons and in the ball sockets of the wobble plate.

2. A diesel engine according to claim 1, wherein said acute angles being in the range of from about 24° to about 36°.

3. A diesel engine according to claim 1, wherein lubricating oil bore holes are arranged in the wobble plate so as to provide an increase in lubricant pressure as the wobble plate rotates.

4. A diesel engine according to claim 1, wherein the wobble plate has sockets to receive the ball sockets and ball joints, the ball sockets having a circular lubricating groove to assure a continuous flow of oil for the lubrication and cooling of the bearings and pistons.

5. A diesel engine according to claim 1, wherein the connecting rods are provided on both ends with hollow spheres which in ball sockets and ball joints establish the connection between the pistons and the wobble plates, the hollow connecting rods assuring transfer of lubricating oil to the pistons for spray lubrication of engine cylinder running surfaces and cooling of the pistons.

6. A diesel engine according to claim 1, wherein the cylinders, together with exhaust and scavenging slots are identical over their circumference and are distributed uniformly and regularly so as to assure an omnisymmetrical distribution of heat and prevent thermal stresses across webs connected between the exhaust and scavenging slots, said webs including a lubricant bore hole.

7. A diesel engine according to claim 1, wherein each connecting rod is provided with a lubricating bore in the connecting rod spherical end, said bore extending approximately perpendicular to the longitudinal axis of the connecting rod, and lubricating passages in said pistons communicating with said connecting rod bore for conducting oil to the interior of said piston.

8. A diesel engine comprising a plurality of cylinders open on opposite ends and arranged in a parallel and concentric manner around an output shaft, two pistons being mounted for reciprocating movement in each cylinder toward and away from each other to form a common combustion chamber between the pistons, each cylinder having air inlet slots and exhaust outlet slots with one of said pistons controlling flow of gas through the outlet slot of the cylinder, the other of said pistons controlling flow of air through the inlet slot of the cylinder, the output shaft having a wobble bearing on each end and a wobble plate seated on each of said wobble bearings, said wobble plate and said wobble bearing being mounted for rotation about a central axis that is aligned with said output shaft, said wobble plate being provided with a plurality of circumferentially arranged ball sockets corresponding to the number of cylinders, ball sockets on each of the pistons and connecting rods provided with spherical ends being seated in the ball sockets of the pistons and in the ball sockets of the wobble plates, the wobble bearings being step bearings having conical bearings maintaining said wobble plate in a predetermined wobble plane, the wobble plane intersecting the axis of the output shaft at an acute angle, the wobble plates have a predetermined number of pivots and slide blocks to absorb reaction forces and counter torques, the slide blocks reciprocatingly oscillate in thrust bearings in accordance with the wobbling motion, the thrust bearings being flanged in a bearing shell on the engine housing and secured thereto.

9. A diesel engine comprising:

a plurality of cylinders, each cylinder having a pair of opposed pistons with interior chambers and interior oil passages, frame means mounting said cylinders concentrically about a drive shaft, power transmission means for transmitting power from said pistons to said drive shaft, said transmission means including a pair of hubs mounted on said shaft adjacent opposite ends of said cylinders for rotation with said shaft, said hubs having a circular bearing surface concentric with said shaft and hub oil passages extending outwardly from a central axis, the central axis of said bearing surface intersecting the central axis of said shaft at an acute angle, a pair of ring means surrounding each of said hubs, said ring means having bearing surfaces cooperating with said hub bearing surfaces allowing relative rotation between the respective hubs and ring means, restraining means for preventing rotation of said ring means about said shaft, and allowing oscillation, as said hub rotates relative to said ring means, connecting rod means for connecting each of said pistons with said ring means, said connecting rod means including for each piston a socket on said ring means and a socket on said piston with a connecting rod extending between said ring means socket and said piston socket and oil passages communicating with said hub passages, said connecting rod being hollow and having hollow balls at each end, the hollow interior of said connecting rod communicating with said interior oil passages in said pistons.

10. A diesel engine comprising:

a plurality of cylinders, each cylinder having a pair of opposed pistons, frame means mounting said cylinders concentrically about a drive shaft, power transmission means for transmitting power from said pistons to said drive shaft, said transmission means including a pair of hubs mounted on said shaft adjacent opposite ends of said cylinders for rotation with said shaft, said hubs having a circular bearing surface concentric with said shaft, the central axis of said bearing surface intersecting the central axis of said shaft at an acute angle, said cylinders each having inlet ports and exhaust ports extending axially and having a fuel nozzle between said inlet and exhaust ports, actuator means on said frame means, said actuator means being connected with said shaft, means mounting said shaft for axial displacement relative to said frame means in response to operation of said actuator means, and pressure responsive means for operating said actuator means to displace said shaft axially in response to a predetermined pressure signal to said pressure responsive means, whereby axial displacement of said shaft also displaces said hubs, thereby causing said exhaust ports to be closed earlier by said piston and said air inlet ports so that increased power is achieved.

11. The diesel engine according to claim 10 wherein said actuator means includes an actuator piston concentric with said shaft, bearing means between said actuator piston and said shaft whereby operation of said actuator means displaces said piston and bearing means axially with said shaft.

12. The diesel engine according to claim 11 wherein said pressure responsive means includes a valve and conduit means for conducting oil under pressure to one side of said piston when said valve is open.

13. A diesel engine comprising:

a plurality of cylinders, each cylinder having a pair of opposed pistons, frame means mounting said cylinders concentrically about a drive shaft, power transmission means for transmitting power from said pistons to said drive shaft, said transmission means including a pair of hubs mounted on said shaft adjacent opposite ends of said cylinders for rotation with said shaft, said hubs having a circular bearing surface concentric with said shaft, the central axis of said bearing surface intersecting the central axis of said shaft at an acute angle, said cylinders being in the form of an aluminum alloy tube, steel sleeves superimposed on said cylinders, said sleeves being spaced radially from at least portions of said tube to form coolant passages between said tube and said sleeve, said sleeves being shrunk fit on said cylinders along a central portion of said cylinders, said coolant passages being formed at opposite ends of said central portion, and means for supplying coolant liquid to said coolant passages, wherein said cylinders include fuel nozzles mounted in said sleeve on said cylinders between said pistons, and including coolant conduits in said sleeve communicating on opposite sides of said nozzles through said coolant passages.

* * * * *

UNITED STATES PATENT AND TRADEMARK OFFICE

CERTIFICATE OF CORRECTION

PATENT NO. : 4,905,637

DATED : March 6, 1990

INVENTOR(S) : Edwin Ott

It is certified that error appears in the above-identified patent and that said Letters Patent is hereby corrected as shown below:

On the title page, item [57] ABSTRACT:

line 1, delete "a" and insert --two--; delete "plate" and insert --plates--.
line 6, delete "stepped pistons" and insert --axial displacing of the main shaft--.

Column 1, line 9, delete "know" and insert --known--;
line 60, delete "know" and insert --known--.

Column 2, line 15, delete "162" and insert --169--;
line 16, delete "220" and insert --230--;
line 17, delete "0.75" and insert --0.72--; delete "per"; delete "1.019" and insert --0.976--;
line 19, delete "may";
line 20, delete "be";
line 25, delete "should be analyzed", and insert --however, only in some cases, but generally not--;
line 28, delete "265" and insert --290--;
line 29, delete "195" and insert --213--;
line 34, delete "265" and insert --290--; delete "0.64" and insert --0.582--; delete "0.866" and insert --0.793--;
line 41, delete "such as" and insert --as well as--;
lines 41 and 42, delete "altitudes" and insert --capabilities--;
lines 46 and 47, delete "high charge" and insert --continuous optimum efficiency--;
line 54, delete "+" and insert --to--.

Column 3, line 12, delete "engine" and insert --engines--;
line 14, after "the" insert --hydraulic version of the--;

UNITED STATES PATENT AND TRADEMARK OFFICE

CERTIFICATE OF CORRECTION

PATENT NO. : 4,905,637

DATED : March 6, 1990

INVENTOR(S) : Edwin Ott

It is certified that error appears in the above-identified patent and that said Letters Patent is hereby corrected as shown below:

Column 4, line 33, delete "are carried" and insert --have--;
line 42, after "rods", insert --spheres--.

Column 5, line 36, delete "lubricant" and insert --coolant--;
line 66, delete "1 to 2" and insert --0.001 to 0.002--.

Column 6, line 50, delete "oil to be cooled" and insert --cooling oil--.

Column 7, line 6, delete "gears" and insert --push-pull rods--;
lines 15 and 16, delete "scavening" and insert --scavenging--.

Column 8, line 62, delete "radial bearings" and insert --radiax bearing--.

Column 9, line 45, after the period insert --In the table of Fig. 2, PS refers to horsepower, $V_h$ refers to volume of stroke, and $V_c$ refers to volume of combustion chamber.--

Column 10, line 19, delete "dimenionally" and insert --dimensionally--;
line 57, delete "air" and insert --oil--.

Column 11, line 30, delete "heating" and insert --warm-up--;
line 46, delete "and" (first occurrence) and insert --end--.

Column 12, line 3, delete "plate" and insert --bearing--;
line 4, delete "plate" and insert --bearing--;
line 23, delete "lubricant" and insert --coolant--.

UNITED STATES PATENT AND TRADEMARK OFFICE

CERTIFICATE OF CORRECTION

PATENT NO. : 4,905,637

DATED : March 6, 1990

INVENTOR(S) : Edwin Ott

It is certified that error appears in the above-identified patent and that said Letters Patent is hereby corrected as shown below:

Column 14, line 10, after "ports" insert --close later--.

In The Drawings:

Fig. 1 - Add the numeral 13 and the axis 15.

Fig. 2 - Change "PS" to --HP--.

Signed and Sealed this

Twenty-fifth Day of August, 1992

*Attest:*

DOUGLAS B. COMER

*Attesting Officer*

*Acting Commissioner of Patents and Trademarks*